United States Patent [19]

Westfall

[11] 4,000,825

[45] Jan. 4, 1977

[54] PRESS-ON TWIST-OFF INFESTATION-PROOF CLOSURE FOR OXYGEN SENSITIVE PRODUCTS

[75] Inventor: James E. Westfall, Western Springs, Ill.

[73] Assignee: Continental Can Company, Inc., New York, N.Y.

[22] Filed: May 22, 1974

[21] Appl. No.: 472,137

[52] U.S. Cl. ..... 215/318

[51] Int. Cl.[2] ..... B65D 41/04

[58] Field of Search ..... 215/318, 327, 334, 337, 215/341, 343, 345

[56] References Cited

UNITED STATES PATENTS

| | | | |
|---|---|---|---|
| 3,110,409 | 11/1963 | Chaplin | 215/345 |
| 3,270,904 | 9/1966 | Foster | 215/318 |
| 3,371,813 | 3/1968 | Owen | 215/318 |
| 3,473,684 | 10/1969 | Wagner | 215/327 X |
| 3,690,497 | 9/1972 | Lecinski | 215/318 |

*Primary Examiner*—Donald F. Norton
*Attorney, Agent, or Firm*—Lockwood, Dewey, Zickert & Alex

[57] ABSTRACT

A press-on turn-off closure cap for glass containers which have a top rim sealing finish, a contiguous frusto-conical sealing finish, and on the neck therebelow a circumferential band of thread formations. The closure cap has a cup-shaped shell with a top panel and a two-step depending skirt. The shell is lined at the juncture of the top panel and the upper inner step with an annular gasket formed of solid plastisol or the like which provides hermetic sealing engagement with both the top rim finish and also the contiguous frusto-conical side seal finish. In addition the lower step of the shell is lined with a circumferential gasket which after being pushed down over the band of thread formations takes a cold-flow set so as to form mating thread formations capable of camming the closure cap off the container on relative rotation between the cap and container.

1 Claim, 7 Drawing Figures

PRESS-ON TWIST-OFF INFESTATION-PROOF CLOSURE FOR OXYGEN SENSITIVE PRODUCTS

This invention relates to innovations and improvements in closure caps for glass containers, particularly closure caps of the press-on turn-off type for use on glass containers having hermetic sealing finishes providing both top and side seals.

Closure caps of the press-on turn-off type for glass containers are known and have been shown and described, in U.S. Pat. Nos. 3,690,497, 3,270,904 and 3,371,813. The closure caps shown and described in these patents include top and side seal providing gaskets of the type which line the cap skirts and permit the closure caps to be pressed vertically downwardly onto the mouths of glass containers the necks of which are provided with circumferential bands of thread formations. The gaskets are formed of suitable plastomeric compounds such as plastisols, which are capable of taking cold flow sets under compression and thereby form thread formations which compliment or mate with those on the neck of the containers and permit the caps to be removed by rotation and thereby camming off as a result of conventional screw action.

The object of the present invention, generally stated, is the provision of improved press-on turn-off closure caps of the foregoing type which are particularly suitable for oxygen-sensitive products such as baby food meat products and which caps provide excellent resistance to infestation and controlled desirably low opening torques.

A further object of the invention is the provision of improved press-on turn-off closure caps characterized by the following features: They have upper annular gaskets formed of solid plastisol or other plastomeric gasket-forming material which fill annular channels in the top panels of the closure cap shells, provide hermetic top seals and have downwardly tapering, outwardly flared extensions providing hermetic side seals. The closure cap shells of the caps are stepped with the inner upper step including a frusto-conical skirt portion which in seated relationship on a container embraces a frusto-conical sealing finish thereon with the frusto-conical skirt portion being appreciably steeper than the frusto-conical glass finish so that the downwardly tapering side seal gasket portion is compressibly wedged therebetween with the formation of a narrow or line-like highly compressed area which is radially relatively thin and highly compressed so as to provide a highly resistant obstacle to leakage. The caps have lower circumferential gaskets which line the lower outer step portions of the shells and which on seating are compressibly engaged with the thread formations on the neck of the glass containers and take cold-flow sets resulting in self-molded thread formations permitting turn-off removal.

The improved closure caps of the present invention may have certain other additional features as desired and as will be explained below.

Certain other objects of the invention will be obvious and others will be apparent from the following detailed description.

For a more complete understanding of the nature and scope of the invention reference may now be had to the following detailed description of a presently preferred embodiment thereof taken with the accompanying drawings in which.

Figure 1:
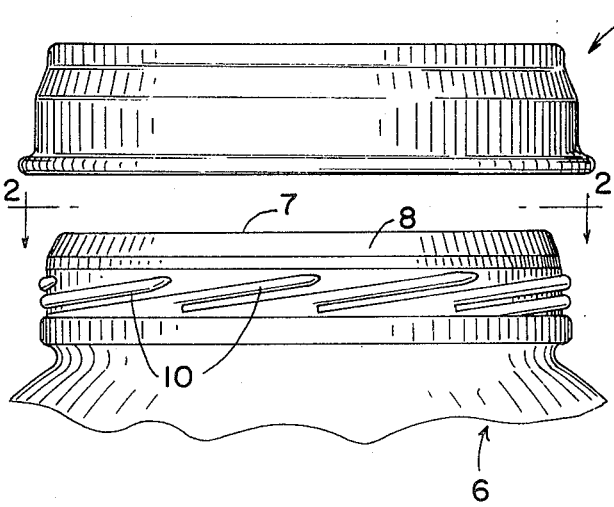
FIG. 1 is a composite side elevational view of a press-on turn-off cap made in accordance with the present invention raised above the mouth and neck of a glass container.
Figure 2:
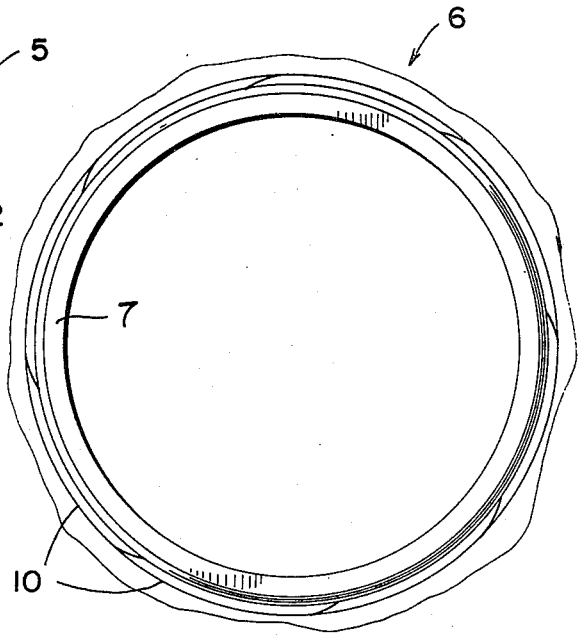
FIG. 2 is a top plan view of the finish on the glass container taken on line 2—2 of FIG. 1.
Figure 5:
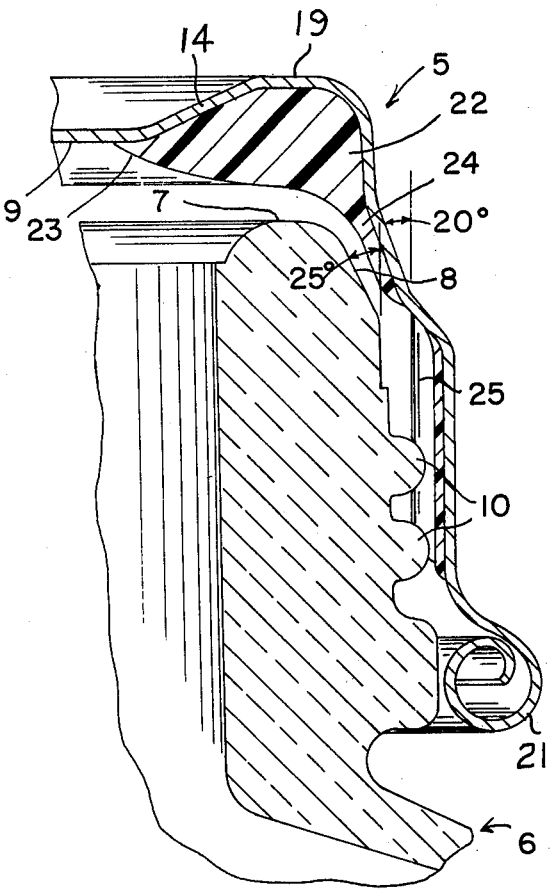
FIG. 5 is a fragmentary detailed vertical sectional view on larger scale showing the relationship between the closure cap of FIG. 1 and the glass finish of FIG. 1 before the cap is pressed on the container.

Referring to FIGS. 1 and 2, a press-on turn-off closure cap made in accordance with the present invention is indicated generally at 5 for hermetically sealing a glass container 6 on the mouth or top opening of which is provided with a top rim seal 7, a frusto-conical side seal 8 and therebelow a circumferential band of discontinuous threads 10—10. The top rim finish 7 and contiguous frusto-conical side seal finish 8 together with the threads 10—10 are shown in detail in FIGS. 5 and 6. As indicated in FIG. 5 the angle of inclination of the frusto-conical surface 8 is 25° from the vertical (65° from the horizontal). The significance of this angle will be brought out below. The structure of the closure cap 5 is shown in detail in FIGS. 3, 4 and 5 being composed of three main elements: a generally cup-shaped shell 11, and an upper annular sealing gasket 12 and a lower generally cylindrical sealing gasket 13.

The shell 11 is formed with a top panel portion 9 with the margin thereof having a downwardly turned channel formation 19 having an inclined inner wall 14 and a generally vertical outer wall 15 which forms part of the upper inner step of the downwardly depending skirt 16. The upper and inner step includes a frusto-conical skirt portion 17 (FIG. 6) having an angle of inclination of 20° (FIG. 5) from the vertical (70° from the horizontal). The bottom of the frusto-conical skirt portion 17 is connected to the upper end of a generally cylindrical skirt portion 18 by the relatively short inner connecting outwardly flared shoulder portion 20. It will be noted that the frusto-conical skirt portion 17 and the shoulder portion have approximately equal radial widths. The bottom end of the cylindrical skirt portion 18 flares outwardly and then is curled inwardly into the circumferential bottom bead 21. The method by which the cap shell 11 may be economically formed in known manner on a mass production basis from suitably enameled or lacquered tin plate, aluminum or other known material. The techniques and machinery for forming the cap shells are known and commercially available.

Figure 3:
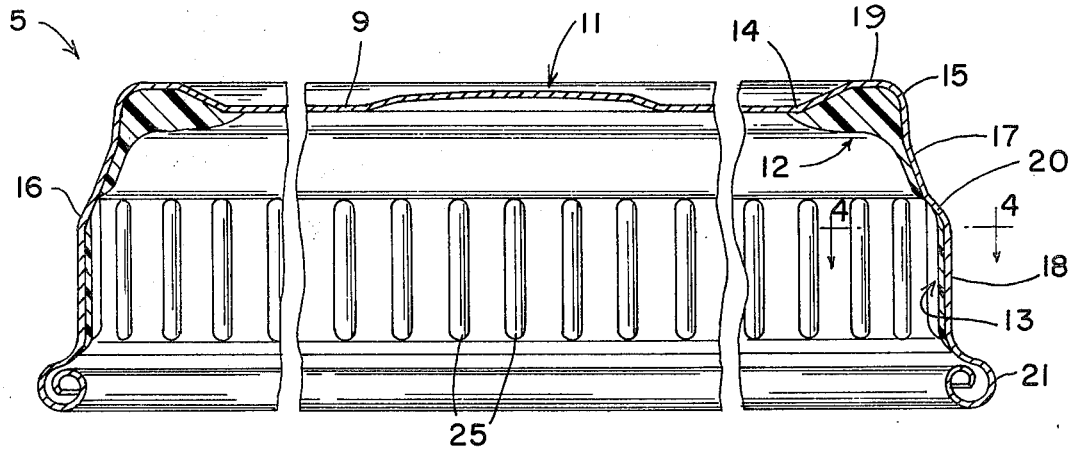
FIG. 3 is a diametric vertical sectional view on enlarged scale of the closure cap shown in FIG. 1.

The upper annular sealing gasket 12 may be formed in known manner from a plastomeric material, for example, a plastisol composition as described in Unger and Zipper U.S. Pat. No. 2,874,863. Such plastisol compositions are also referred to as solid cross-linked PVC (polyvinylchloride) material. After the proper amount of such gasket material has been lined or flowed into the cap shell 11 while in the inverted position and molded to desired shape and contour in known manner the same is then fluxed so as to take a permanent shape as shown in FIGS. 3 and 5. This shape includes an upper channel-filling portion 22 the radially inner portion of which covers the inner shoulder or wall 14 of the shell and extends slightly beyond terminating in a feather edge 23 in accordance with the teachings of Zipper U.S. Pat. No. 2,841,304. Below the channel-filling portion 22 the gasket 12 has a downwardly depending tapering portion 24 which lines the frusto-conical skirt portion 17 and terminates at the juncture of the outwardly flared shoulder 20 and the frusto-conical skirt portion 17. It will be seen that the vertical height of the tapered gasket portion 24 is several times the vertical depth of the down-turned channel 19.

Figure 4:
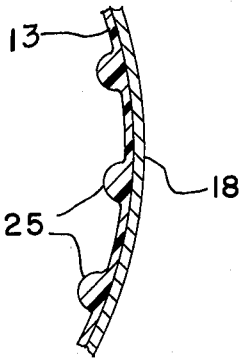
FIG. 4 is a fragmentary detail sectional view taken on line 4—4 of FIG. 3.

The generally cylindrical gasket 13 which lines the cylindrical skirt portion 18 is preferably provided with a series of circumferentially spaced vertically extending flutes or ribs 25—25 and is relatively thin in cross section intermediate these flutes (FIG. 4). The gasket 13 extends upwardly preferably far enough to join the upper gasket 12 and extends downwardly to the place where the cap shell begins to flare outwardly into the bead 21.

When the upper annular gasket 12 and the lower cylindrical gasket 13 are formed of the same plastomeric material they may be integral or interconnected. In this connection, the unfluxed plastisol or other solid gasket forming material is at first deposited in the inverted cap shells 11 so as to be substantially uniformly distributed one or more beads or ribbons therearound and then the formation of the gaskets is completed by means of a suitable molding punch in accordance with known techniques such as described, for example, in U.S. Pat. No. 3,473,683.

Figure 7:
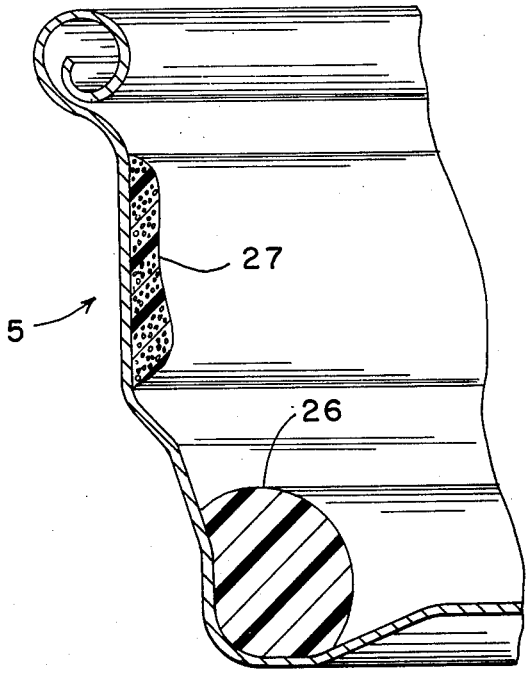

It may be desired that the upper gasket 12 be formed of one solid type gasket material while the lower cylindrical gasket 18 is formed of either a different solid type gasket material, or of a so-called puffed compound which provides lower opening torques than are provided with solid type compounds. Accordingly, a ribbon or bead of the solid gasket-forming compound will be deposited or lined into the corner portion of the inverted shell as indicated at 26 in FIG. 7 while a ribbon or band of puffed compound for the cylindrical gasket 13 is lined in the skirt portion 18 indicated at 27 in FIG. 7. Upon insertion of a suitable molding punch into the cap shell the two gasket deposits 26 and 27 are shaped so as to conform them to the configurations and cross sections shown in FIGS. 3, 4 and 5.

The closure caps 5 may be applied at high speeds to filled containers 6 using known methods and machinery such as available in the baby foods industry. The caps 5 are applied by pressing the same down onto filled containers 6 with head spaces occupied by steam or vapor. Upon being seated on the containers the caps 5 form initial hermetic seals and upon condensation of the steam or vapor in the head spaces vacuums are created and the initial hermetic seals are maintained and perfected. The seated relationship of the cap 5 on the container 6 is shown and illustrated in FIG. 6. It will be seen that the top rim finish 7 on the container presses and indents into the upper annular gasket 12 in the corner of the cap shell 11 and causes the same to bulge radially inwardly as indicated at 28. At the same time the downwardly tapering portion 24 of the gasket is compressed and ironed out between the frusto-conical finish 8 on the glass container and the embracing frusto-conical skirt portion 13 on the cap. As pointed out in connection with FIG. 5 these two frusto-conical elements are angularly mis-matched with the result that when the cap 5 is seated the frusto-conical skirt portion 17 extends below the lower end of the frusto-conical finish portion 8 in what amounts to or approaches a line contact is formed between these two frusto-conical surface with the gasket material thereat being highly compressed therebetween in thin cross section as indicated at 30. This very thin and highly compressed section of the gasket 12 provides a very stubborn leakage path, i.e. acts as an obstacle which is highly resistant to leakage in an axial direction.

Figure 6:
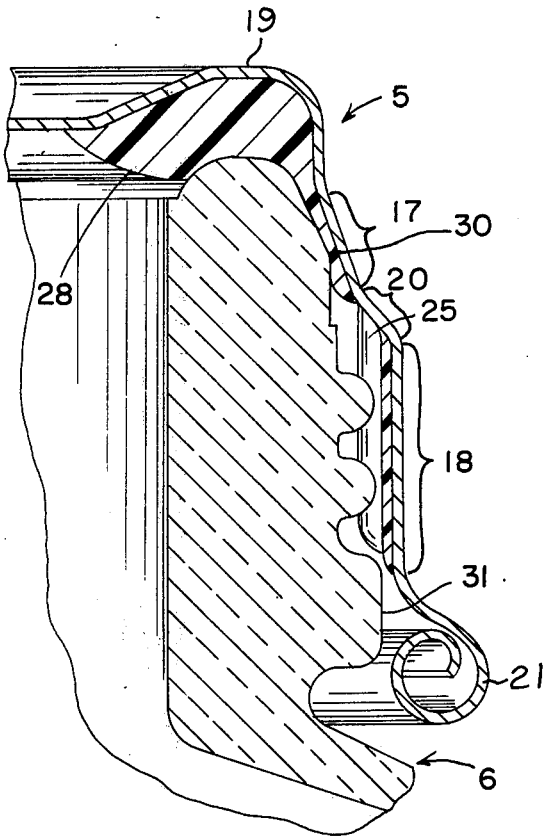
FIG. 6 is a view similar to FIG. 5 but showing the relationship between the cap and the glass finish after the closure cap is in the fully seated and sealed condition on the container; and, FIG. 7 is a fragmentary vertical sectional view on enlarged scale illustrating the manner in which the closure cap may be provided with a two-compound gasket.

The lower cylindrical gasket 13 allows the caps 5 to be pressed directly down over the discontinuous threads 10 resulting in the gasket material in the areas of the vertical flutes 25 being compressed between the vertical skirt portion 18 and the threads 10 as shown in FIG. 6. The gasket material flows around the discontinuous threads and the resulting cold flow takes a set after a relatively short period of time after capping with the result that internal discontinuous threads are formed on the interior of the gasket 13 which match or mate with the embossed threads 10. Later when the cap 5 is rotated relative to the glass container 6 the resulting camming action serves first to break the vacuum and the hermetic seal that has been formed between the upper gasket 12 and the sealing finishes 7 and 8 and on continued rotation serves to lift the cap 5 with respect to the container permitting its ready removal. In the event that the contents of the container 6 are not completely utilized after opening the cap 5 may be re-applied as a dust cover by simply rotating it downwardly and then removed later as desired.

It will be appreciated that the solid plastisol or other plastomeric gasket material forming the upper annular gasket may be selected for its excellent hermetic seal-forming properties while the solid or puffed gasket material forming the gasket section 13 may be selected for it low opening torque properties. These features and the excellent resistance to leakage at narrow band or line-like area where the frusto-conical skirt portion 17 most closely approaches the frusto-conical finish 8 make the caps 5 particularly suitable for oxygen-sensitive products such as baby foods. In addition the close conformation of the bead 21 on the cap 5 to the opposing circumferential bead 31 on the container 6 offers high resistance to infestation.

It will be understood that minor changes, other than those mentioned above, may be made in the foregoing embodiments of the invention and that other embodiments of the invention may be made without departing from the spirit and scope of the invention. For example, instead of having embossed discontinuous cam-off threads 10 on the container 6 there would be a continuous thread, and instead of being embossed the threads could be in the form of depressions or pockets in the glass finish.

I claim:

1. In a press-on turn-off gasket closure cap of the combination top and side seal type for use in establishing and maintaining a hermetic seal on a glass container of the type in which the upper edge of the rim together with a frusto-conical portion of the side surface thereof provide the hermetic sealing finish and the outer surface of the container neck below said frusto-conical finish has a series of thread formations arranged in a circumferential band therearound, said cap comprising (1) a generally cup-shaped integral shell having a top panel portion having an annular margin which provides a gasketed down-turned channel formation registrable with said upper edge finish and having a stepped skirt portion with the upper inner step thereof being gasketed and depending from the outer wall of said channel formation as a continuation thereof and providing a downwardly and outwardly flared frusto-conical skirt portion embracingly registrable with said frusto-conical finish portion and having an inclination steeper than that of said frusto-conical finish portion and the bottom of which frusto-conical skirt portion joins an outwardly flared shoulder portion the bottom outer periphery of which joins the top of a lower outer cylindrical step terminating at the bottom in a bead, and (2) an upper annular sealing gasket formed of a solid plastisol located generally within the circumferential corner portion of said shell formed by said annular margin and said upper inner step of said stepped skirt portion having its upper and radially inner portion located on the underside of said top panel portion and extending inwardly to at least adjacent the bottom of the inner side wall of said channel formation and with its lower radially outer portion terminating adjacent the bottom of said frusto-conical skirt portion, with said upper annular sealing gasket filling said channel formation and having a downwardly and outwardly tapered gasket portion lining said frusto-conical skirt portion and diminishing radially outwardly in horizontal cross-section below said channel formation, said tapered gasket portion being at least several times longer in a vertical direction than the depth of said channel formation, said channel-filling upper gasket portion sealingly engaging said upper edge finish of a container when said closure cap is hermetically sealed thereon with at least the lower part of said tapered gasket portion being appreciably thinned out by compressed sealing engagement between said frusto-conical finish portion and said frusto-conical skirt portion, the improvement in said closure cap, comprising, a lower generally cylindrical gasket formed of a puffed plastisol capable of taking a cold flow set lining said lower outer cylindrical step and compressingly embracing said series of thread formations of said container neck after being pushed downwardly thereover so as to take a set with respect thereto whereby said closure cap may be removed by rotation with respect to said container.

* * * * *